US006973972B2

(12) United States Patent
Aronstam

(10) Patent No.: US 6,973,972 B2
(45) Date of Patent: Dec. 13, 2005

(54) METHOD FOR REDUCTION OF SCALE DURING OIL AND GAS PRODUCTION AND APPARATUS FOR PRACTICING SAME

(75) Inventor: Peter S. Aronstam, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 212 days.

(21) Appl. No.: 10/393,083

(22) Filed: Mar. 20, 2003

(65) Prior Publication Data

US 2003/0196816 A1 Oct. 23, 2003

Related U.S. Application Data

(60) Provisional application No. 60/374,864, filed on Apr. 23, 2002.

(51) Int. Cl.[7] ..... E21B 37/00; E21B 28/00; G01V 1/02; H04R 17/00; H01L 41/04

(52) U.S. Cl. ..... 166/311; 166/65.1; 166/177.2; 166/246; 310/328; 310/339; 181/113; 367/155

(58) Field of Search ..... 166/250.05, 248, 166/249, 311, 373, 381, 65.1, 117.6, 177.1, 177.2, 117.1, 117.2, 242.4; 310/328, 339; 181/106, 111, 113; 367/153, 154, 155, 157, 166, 310, 181, 367

(56) References Cited

U.S. PATENT DOCUMENTS

| | | | | | |
|---|---|---|---|---|---|
| 3,583,677 | A | * | 6/1971 | Phillips | 366/120 |
| 3,648,769 | A | * | 3/1972 | Sawyer | 166/177.2 |
| 4,437,518 | A | * | 3/1984 | Williams | 166/248 |
| 4,518,888 | A | | 5/1985 | Zabcik | 310/334 |
| 4,525,815 | A | * | 7/1985 | Watson | 367/35 |
| 4,682,070 | A | | 7/1987 | Plambeck | 310/334 |
| 5,109,922 | A | * | 5/1992 | Joseph | 166/65.1 |
| 5,137,109 | A | * | 8/1992 | Dorel | 181/106 |
| 5,184,678 | A | * | 2/1993 | Pechkov et al. | 166/249 |
| 5,297,631 | A | * | 3/1994 | Gipson | 166/299 |
| 5,371,330 | A | * | 12/1994 | Winbow | 181/106 |
| 5,595,243 | A | | 1/1997 | Maki, Jr. et al. | 166/177.2 |
| 5,638,822 | A | * | 6/1997 | Seyed-Bolorforosh et al. | 600/459 |
| 5,727,628 | A | | 3/1998 | Patzner | 166/249 |
| 6,011,346 | A | | 1/2000 | Buchanan et al. | 310/339 |
| 6,135,234 | A | * | 10/2000 | Harris et al. | 181/106 |
| RE37,204 | E | * | 6/2001 | Kompanek | 367/159 |
| 6,320,300 | B1 | | 11/2001 | Kaminski et al. | 310/328 |
| 6,433,464 | B2 | * | 8/2002 | Jones | 310/328 |
| 6,474,349 | B1 | * | 11/2002 | Laker | 134/22.12 |
| 6,619,394 | B2 | * | 9/2003 | Soliman et al. | 166/249 |
| 2001/0011590 | A1 | * | 8/2001 | Thomas et al. | 166/248 |
| 2001/0013410 | A1 | * | 8/2001 | Beck et al. | 166/65.1 |
| 2002/0070017 | A1 | * | 6/2002 | Soliman et al. | 166/249 |
| 2002/0097637 | A1 | * | 7/2002 | Pearce et al. | 367/154 |
| 2003/0001458 | A1 | * | 1/2003 | Christensen | 310/328 |

FOREIGN PATENT DOCUMENTS

WO WO00/79095 A1 12/2000

OTHER PUBLICATIONS

MatWeb.com, The Online Materials Database, EDO Ceramics EC–98 Lead Magnesium Niobate Piezoelectirc, 1 page, undated.*

(Continued)

*Primary Examiner*—David Bagnell
*Assistant Examiner*—Jennifer Gay

(57) ABSTRACT

Scaling may be reduced during oil and gas production using a device having a sound transducer. The device can be used downhole and functions independently of an external power supply. Use of the device allows for the reduction or elimination of anti-scaling chemical additives during the production phase of an oil and gas well.

20 Claims, 3 Drawing Sheets

OTHER PUBLICATIONS

MatWeb.com, The Online Materials Database, Channel Industries 5400 Lead Zirconate Titanate Piezoelectirc, 2 pages, undated.*

MatWeb.com, The Online Materials Database, Channel Industries 300 Barium Titanate Piezoelectirc, 2 pages, undated.*

"Electric Circuit." Encyclopædia Britannica. 2004. Encyclopædia Britannica Online.□□Sept. 1, 2004 <http://www.search.eb.com/eb/article?eu=32833>.□□.*

Asymptote Cool Guide to Cryopreservation; website www.asymptote.co.uk/cryo/manual.shtml.

* cited by examiner

METHOD FOR REDUCTION OF SCALE DURING OIL AND GAS PRODUCTION AND APPARATUS FOR PRACTICING SAME

CROSS-REFERENCE TO RELATED APPLICATIONS

This application takes priority from U.S. Provisional Patent Application Ser. Nos. 60/374,864, filed Apr. 23, 2002, also assigned to the assignee of this application.

BACKGROUND OF THE INVENTION

1. Field of the Invention

The present invention relates to a method for reducing scale during oil and gas production. The present invention particularly relates to non-chemical scale reduction during oil and gas production.

2. Background of the Art

Petroleum fluids primarily comprise oil and water and are herein referred to as formation fluids. A formation fluid may also contain natural gas, and will often contain oil and water insoluble compounds such as clay, silica, waxes, and asphaltenes, which exist as colloidal suspensions.

In addition to the already listed components, formation fluids can also include inorganic components that can precipitate to form mineral scales. The process of mineral scale precipitation is known as scaling. Of primary concern to this invention are mineral scales and scaling. The most common scale forming ions are calcium and barium, but sodium, carbonate, bicarbonate, chloride, sulfate, and strontium are also recognized as scaling species. The most common speciation of these combined scaling ions are: calcium carbonate ($CaCO_3$), calcium sulfate ($CaSO_4$), barium sulfate ($BaSO_4$), and strontium sulfate ($SrSO_4$). In addition, there are less common scale species, such as calcium fluoride ($CaF_2$), iron sulfide ($Fe_xS_{x+1}$), zinc sulfide (ZnS), lead sulfide (PbS) and sodium chloride (NaCl).

Scale precipitation is primarily affected by commingling of incompatible produced waters and/or changes in physical properties intrinsic to the well system such as: temperature, pressure, fluid turbulence, fluid flow rate, and pH. Specifically, well equipment in positions where incompatible water commingles and/or changes in these intrinsic physical properties occur is particularly vulnerable to scale precipitation. It has also been recognized that well equipment and topside equipment downstream of these sites are also susceptible to scale precipitation in the well system. Any mineral scale sticking to the well system surfaces may narrow pipes, and clog wellbore perforations, various flow valves, and other wellsite and downhole equipment, which results in wellsite equipment failures. It may also slow down, reduce, or even totally prevent the flow of formation fluid into the wellbore and/or out of the wellhead. These effects also extend to crude oil storage facilities that incur maintenance or capacity problems when mineral scale precipitations remain undetected for extended periods of time.

Since mineral scale deposits are undesirable due to these aforementioned problems, it is known in the field of oil and gas production to remove scale from downhole. U.S. Pat. 5,592,243, to Maki, Jr. et al., discloses that an apparatus can be lowered into a borehole that directs high energy sound to the borehole wall and near wellbore formation to dissolve or resuspend material reducing the permeability or the formation or restricting formation fluid flow within the borehole. U.S. Pat. 5,727,628, to Patzner, discloses a similar device that also includes a pump for pumping out water contaminated with the redissolved or resuspended materials.

While the above referenced devices may be effective at cleaning a well that is already afflicted with scale, it is more preferable to avoid scaling altogether, thereby rendering cleaning unnecessary. For example, during oil and gas production in production wells, the drilling of new wells, or workovers of existing wells, many chemicals, referred herein as "additives", which include scale inhibitors, are often injected from a surface source into the wells to treat the formation fluids flowing through such wells to prevent or control the precipitation of mineral scale. These additives can be injected through a conduit or tubing that is run from the surface to a known depth within the formation and typically upstream of the problem location. In addition, an additive can be injected into a near wellbore formation via a technique commonly referred to as "squeeze" treatment, from which the additive can be slowly released into the formation fluid. Sometimes, additives are introduced in connection with electrical submersible pumps, as shown for example in U.S. Pat. No. 4,582,131, or through an auxiliary line associated with a cable used with the electrical submersible pump, such as is shown in U.S. Pat. No. 5,528,824.

Despite their effectiveness, the use of chemical additives is not without problems. Applying chemical additives efficiently, particularly in remote oil fields that do not permit easy access for chemical delivery and onsite monitoring, is sometimes difficult. Similarly difficult to implement are solutions such as that of WIPO Publication No. WO 00/79095 A1, to Acton, et al., which discloses using ultrasound to create seed crystals for injection into a supersaturated solution to reduce deposition of a mineral salt. The apparatus disclosed is too bulky for use downhole and requires an external power supply. Such an device would be difficult to use in oil field operations, particularly when such operations are in remote locations.

SUMMARY OF THE INVENTION

In one aspect, the present invention is an apparatus for reducing scaling during oil and gas production comprising: (a) at least one sound transducer for producing sound having a frequency and intensity sufficient to initiate the precipitation of solids from a formation fluid that would otherwise form as scale, (b) a piezoelectric generator for producing power for the at least one sound transducer, and (c) a connection between the sound transducer and the piezoelectric generator; wherein the connection between the sound transducer and the piezoelectric generator functions to transfer electromotive force from the piezoelectric generator to the sound transducer.

In another aspect, the present invention is a method for reducing scaling during oil and gas production comprising placing into a fluid flow path containing formation fluid: (a) at least one sound transducer for producing sound having a frequency and intensity sufficient to initiate the precipitation of solids from a formation fluid that would otherwise form as scale, (b) a piezoelectric generator for producing power for the at least one sound transducer, and (c) a connection between the sound transducer and the piezoelectric generator; wherein the connection between the sound transducer and the piezoelectric generator functions to transfer electromotive force from the piezoelectric generator to the sound transducer.

It would be desirable in the art of oil and gas production to reduce scaling without resort to chemical additives. It would be particularly desirable to reduce scaling without resort to chemical additives using an apparatus not requiring an external energy source or routine maintenance.

BRIEF DESCRIPTION OF THE DRAWINGS

For a detailed understanding and better appreciation of the present invention, reference should be made to the following detailed description of the invention and the preferred embodiments, taken in conjunction with the accompanying drawings, wherein.

Figure 1:
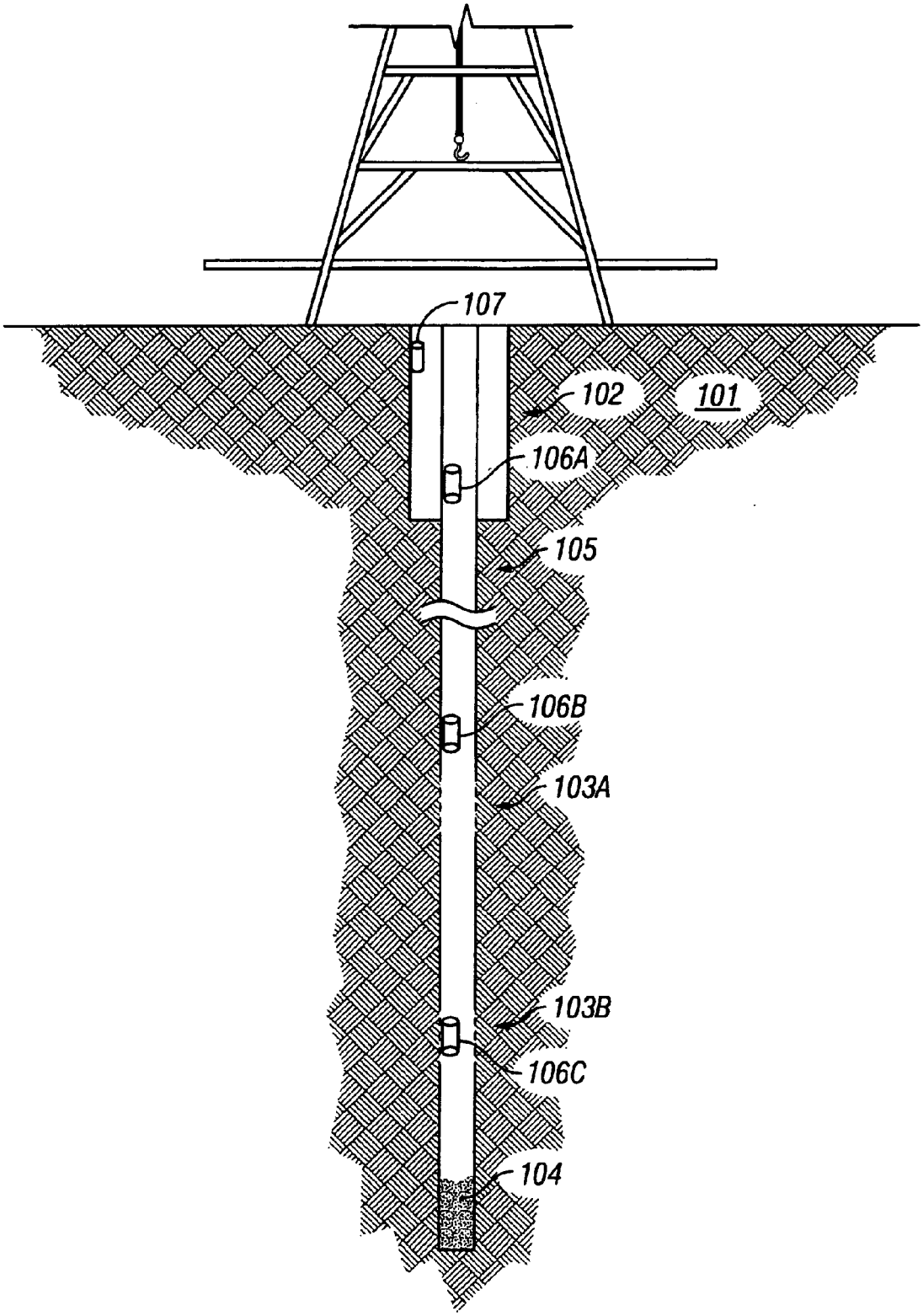
FIG. 1 is a schematic overview showing an apparatus of the present invention in place downhole in an oil well.

It will be appreciated that the figures are not necessarily to scale and the proportions of certain features are exaggerated to show detail.

DESCRIPTION OF THE PREFERRED EMBODIMENTS

In one embodiment, the present invention is a method for reducing scaling during oil and gas production comprising placing into a fluid flow path containing formation fluid an apparatus for reducing scaling during oil and gas production. The apparatus of the present invention is powered by the vibrational energy produced from flowing formation fluid. The vibrational energy is converted to electromotive force (EMF) using a piezoelectric generator.

Piezoelectric generators are known. U.S. Pat. No. 4,518,888 to Zabcik discloses an apparatus for absorbing vibratory energy to generate electrical power. One embodiment of the Zabcik invention is a stack of piezoelectric elements arranged in an electrically additive configuration that captures vibrational energy from a rotary drill string and converts it into electrical energy for driving electrical devices.

A piezoelectric effect includes the voltage produced between surfaces of a solid dielectric substance when a mechanical stress is applied to it. Certain crystals, e.g., quartz and Rochelle salt, and ceramic materials, exhibit the piezoelectric effect, which was discovered by Pierre Curie in 1883. The early materials, such as quartz, lithium sulphate or barium titanate, are not used as commonly as before, particularly for ultrasonic sound generation. Instead, new powerful piezoelectric materials are available.

Depending on the application, the new piezoelectric dielectrics can be more advantageous due to physical or economic reasons, or simply because of a less complicated manufacturing process. Exemplary of these materials are lead zirconate titanate, lead magnesium niobate, barium titanate, lead metaniobate ($PbNb_2O_6$), polyviylidenefluoride (PVDF copolymer), and the like. While one or more of these materials may be preferable, any piezoelectric dielectric that can be used under the operating conditions of oil and gas production can be used with the apparatus and method of the present invention.

For convenience, the term "piezoelectric dielectrics" has been used in this application to refer to the materials used to convert vibrational energy to electrical energy and, at least in regard to sound transducers, vice versa. Any material that can perform this function is intended to be within the scope of the claims of this application. For purposes of the present invention, a piezoelectric dielectric is any material that can convert vibrational energy to electrical energy, whether it is a material that is conventionally considered a piezoelectric dielectric or not. For example, alloys of Tb, Dy, and Fe, which are marketed under the trade designation TERFENOL-D® are, for purposes of the present invention, piezoelectric dielectrics. Ni alloys that can perform the same function, though not conventional piezoelectric dielectrics, are for purposes of the present invention, also piezoelectric dielectrics. Also for purposes of the present invention, piezoelectric generators are generators that utilize piezoelectric dielectrics as defined herein to convert energy from the pulse flow of formation fluid into EMF.

In addition to the piezoelectric dielectrics, the piezoelectric generators of the present invention will include devices such as charge converters, rectifiers and amplifiers to convert the charge output from a piezoelectric dielectric to electric current, as well as the necessary connectors, cables, busses, and the like, needed for the device to fulfill its purpose of providing electrical current to the sound transducer.

While the method of the present invention can be practiced with the apparatus for reducing scaling located anywhere in a system for producing oil and gas, including within: an oil well, a pipeline, and a stirred or agitated vessel, it is preferable that the apparatus be employed at a location wherein its self-contained electrical generation offers a financial or technical advantage over conventional methods of reducing scaling.

A description of one embodiment in accordance with the present invention is made with reference to FIG. 1. FIG. 1 is a schematic overview showing apparatuses for reducing scaling of the present invention in place downhole in an oil well. In this figure, an apparatus for reducing scaling (106A) is fixed in the wellbore (105) at a point relatively near the surface and within the casing (102). Another such apparatus (106B) is fixed in the wellbore (105) at a point much deeper than the first and just above the first production zone (103A) in the wellbore (105). A third such apparatus (106C) is fixed in the wellbore (105) at a point still deeper, within the second production zone (103B) in the wellbore (105) and above the gravel pack (104) at the bottom of the wellbore (105), the effects of which could extend into the near wellbore region.

Formation fluid enters the wellbore (105) from the formation (101) at two porous regions of the formation (103A and 103B) located at or below the level of the apparatuses for reducing scaling (106A and 106B and 106C). The hydraulic pressure of the formation (101) forces the formation fluid up the wellbore (105) and through the apparatuses for reducing scaling (106A and 106B and 106C). A very small part of the hydraulic pressure energy of the formation fluid is converted to EMF and used to actuate a sound transducer that converts the EMF to sound. The sound thus produced is directed into at least a portion of the formation fluid moving past the apparatuses for reducing scaling (106A and 106B and 106C).

The sound produced by the apparatuses for reducing scaling (106A and 106B and 106C) acts to precipitate the materials that would otherwise form scale deposits downstream. Though not wishing to be bound by any theory, it is believed that the deposition of scale is caused by the scaling materials reaching a point of saturation as they approach and exit the formation (101). The formation (101) being a point of high temperature and high pressure, formation fluid leaving the formation and entering the well bore (105) is subjected to increasingly lower temperatures and pressures as it travels up the well bore (102) and at some point, the formation fluid reaches saturation with scale producing materials. The sound waves from the sound transducer, traveling as compression waves, impart additional energy to the saturated formation fluid to promote the formation of seed particles that in turn promote additional particulate precipitation of scaling materials. This production of inorganic particles is more desirable than the scaling materials forming scale on the well bore, tubing and other components of the oil well and oil collection system.

While the present invention is directed primarily to reduction of scaling, other materials present in production fluid can also be affected by the scale reduction devices of the present invention. For example, paraffins and asphaltenes can be, at least in some degree, affected by ultrasound or infrasound. It is contemplated that precipitation of one or both of these material can be initiated using the scale reduction devices of the present invention. Further it is contemplated that precipitation of one or both of these material can be selectively initiated using the scale reduction devices of the present invention.

Figure 2A:
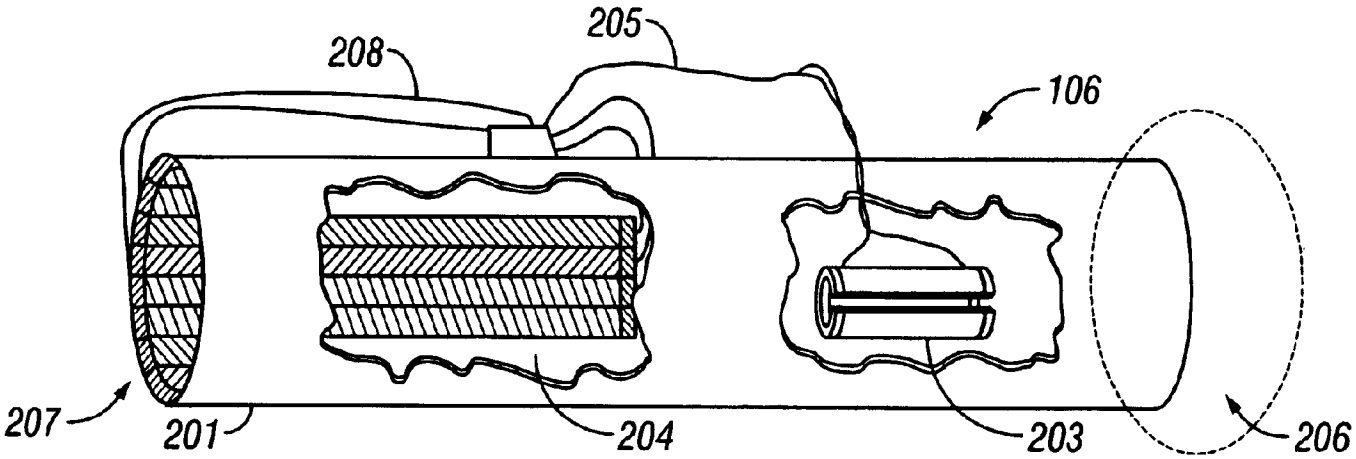
FIG. 2 is a schematic overview of a general embodiment of an apparatus of the present invention, including a side view 2A, and an enlarged and detailed interior view of the end portion of the apparatus labeled 2B.
Figure 2B:
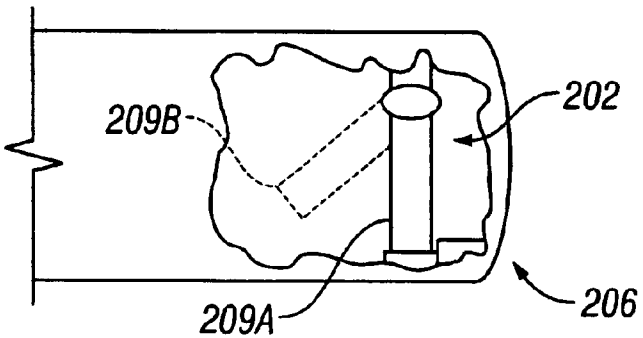

FIG. 2 is a schematic overview of a general embodiment of an apparatus for reducing scaling of the present invention. The apparatus for reducing scaling (106) generally comprises a housing (201) that has an entrance (206) and an exit (207). Located within the housing (201) is a pulse flow generator (202) that acts upon formation fluid flowing into the entrance (206) and through the housing (201) and out of the exit (207) to create pulses in the flow of the formation fluid in the flow path within the housing (201). The pulse flow generator (202) as shown is a dumb flapper valve, but can be any such device known to those of ordinary skill in the art of preparing such devices, including but not limited to a propeller or impeller which is electronically or mechanically controlled to generate pulses. These pulses are a series of high and low flow rates, as compared to the flow rate of the formation fluid, and are of very short duration and have sufficient energy to interact with the piezoelectric generator (204) to produce an EMF.

The pulsed flow of formation fluid interacts with the piezoelectric elements in the piezoelectric generator (204) to produce an EMF sufficient to drive the sound transducer (203). The electric current generate by the impact of the pulsed flow of formation fluid is carried to a conditioning device (208) which conditions the electric current, and then to the sound transducer (203) by a connection (205) such as a cable or solid-state bus. Not shown specifically are the other elements known to those of ordinary skill in the art of preparing piezoelectric generators including but not limited to charge converters, rectifiers and amplifiers, at least some of which are included in the conditioning device (208).

The piezoelectric generator (204) shown in the drawings is not to scale and can vary in size and number according to the requirements of the particular well being treated to reduce scaling. For example, the piezoelectric generator (204) may be relatively small for an oil well that produces a very high flow of formation fluid or that is being treated with an apparatus for reducing scale that utilizes a low-energy sound transducer. On the other hand, the piezoelectric generator (204) may be relatively large for an oil well that produces a slow flow of formation fluid or that is being treated with an apparatus for reducing scale that utilizes a high-energy sound transducer. One embodiment of the present invention contemplated by the inventor is an apparatus for reducing scaling utilizing standardized components including piezoelectric dielectric arrays that can be connected in a series or parallel, with additional arrays loaded into the housing as required to meet the power requirement of each application. Another embodiment of the present invention would be a standard apparatus for reducing scaling which has a first standard housing that can be connected to one or more additional housings including additional piezoelectric dielectric arrays to provide additional power.

The sound transducers useful as the sound transducer (203) of the present invention are any which can convert the EMF from the piezoelectric generator (204) into sound having a frequency and intensity sufficient to initiate the precipitation of solids that would otherwise form as scale downstream from the scale reductions apparatuses of the present invention (106). One such sound transducer is an ultrasonic transducer that typically would operate at from about 15 to about 25, preferably about 20 khz. Another such sound transducer is an infrasound transducer that could operate at from about 1 to about 8, preferably about 4 khz. The sound transducer (203) shown is a slotted cylinder type.

The form of the sound transducer (203) of the present invention can vary with the requirements of the oil well to be treated to reduce scale. For example, one form can be a simple cylinder with piezoelectric elements directing ultrasound inward toward the center of the cylinder. Another form is a similar cylinder with an infrasound generator directing infrasound into the cylinder forming a standing wave therein. In yet another form, the sound transducer (203) is an array of piezoelectric elements in a slotted cylinder.

In FIG. 2, section A, the pulse flow generator (202) shown is a flapper valve type. The flapper is shown in both a closed (209A) and an open (209B) position. By opening and closing, the pulse flow generator produces a pulse flow that in turn interacts with the piezoelectric generator (204) to produce an EMF. For oil wells producing from formations that have a naturally pulsed flow of formation fluid, no pulse flow generator is required. For oil wells that have flows that are so intermittent or otherwise cause problems with dumb pulse flow generators, a smart pulse flow generator can be used.

For devices of the present invention that have a smart pulse generator, it is preferable that the device also includes a combination electrical storage device and electronic controller (not shown) that is connected to the smart pulse flow generator and the piezoelectric generator (204). In this embodiment, the additional element of a combination storage device and controller can be charged prior to installation and then used to control the smart pulse flow generator to produce the optimum pulse rate in the formation fluid flow. The combination storage device and controller can be kept charged by the piezoelectric generator (204). One advantage of this embodiment is that the combination storage device and controller can be programmed to sense periods of no flow and shut down and then reactivate itself upon resumption of production.

The apparatuses for reducing scaling of the present invention can be sized according to their intended use. Preferably, the diameter of the housing will be less than the diameter of the well bore at the point optimum to place the apparatus, but wide enough to receive sufficient flow to power the sound transducer (203).

The apparatuses for reducing scaling of the present invention can be placed anywhere within an oil well and its attendant product collection system where there is a sufficient formation fluid flow to power the sound transducer.

Preferably, the apparatus is located downhole. Most preferably, the apparatus is located downhole at point wherein the formation fluid reaches saturation in scaling components.

The advantages of the present invention also include the features of very low maintenance and no scheduled maintenance. There are very few moving parts other than the piezoelectric dielectric arrays and these require much less maintenance than, for example, the pumps required to pump additives downhole. Another advantage of the present system is that it produces significant sound when functioning. A simple receiver, shown in FIG. 1 as (107), at the surface could be used to monitor the apparatus of the present invention for failures and then send a message for service only upon its failure to produce sound. This is a particular advantage in remote oil and gas fields where it is sometimes difficult to have a technician make scheduled service calls.

Figure 3:
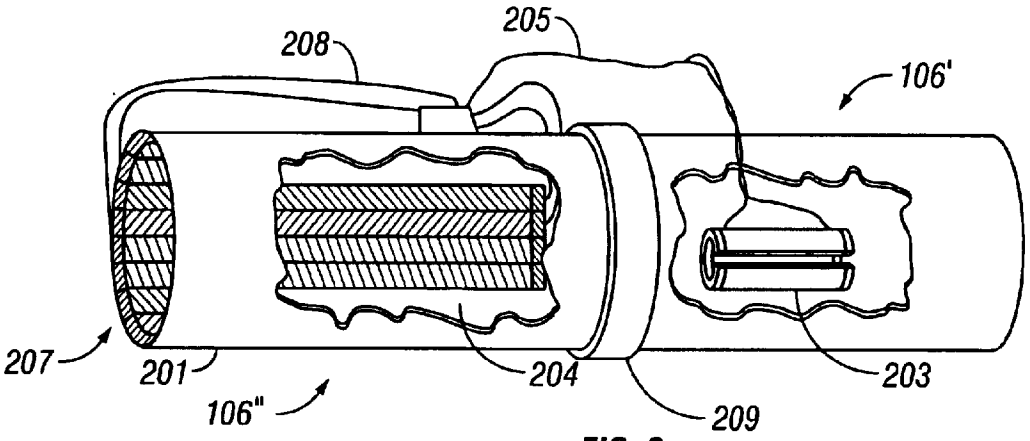
FIG. 3 is a schematic overview of a specific embodiment of an apparatus of the present invention having more than one housing.
Figure 4:
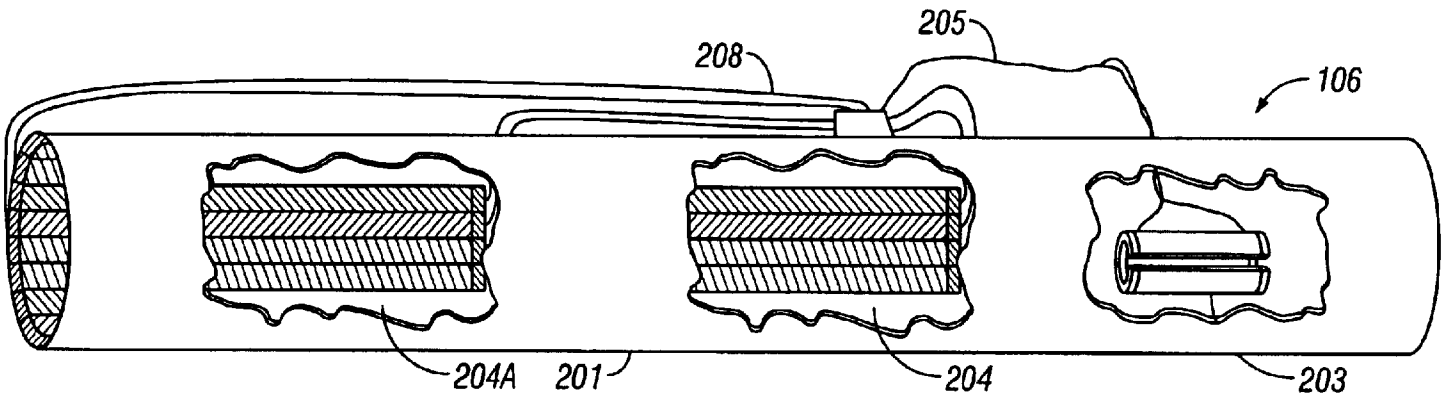
FIG. 4 is a schematic overview of a specific embodiment of an apparatus of the present invention having more than one piezoelectric array.

While FIGS. 1, 2A, 2B, and 4 show single housing apparatuses for reducing scaling, the use of multiple housing apparatuses, as shown in FIG. 3 wherein 106' and 106" are two housings coupled using a collar (209), is also within the intended scope of the claims. Also included within the intended scope of the claims are apparatuses including multiple sound transducers and combinations of sound transducer types and piezoelectric arrays, as shown in FIG. 4 wherein (204) and (204A) are two piezoelectric arrays and a second sound transducer (not shown) is attached to the housing between the two piezoelectric arrays. The use of multiple apparatuses, particularly in oil wells producing from more than one level in the formation is also with the scope of the method claims of the present invention.

It is further noted that while a part of the foregoing disclosure is directed to some preferred embodiments of the invention or embodiments depicted in the accompanying drawings, various modifications will be apparent to and appreciated by those skilled in the art. It is intended that all such variations be within the scope of the claims.

What is claimed is:

1. An apparatus for reducing scaling during oil and gas production comprising:

(a) at least one sound transducer for producing sound having a frequency and intensity sufficient to initiate the precipitation of solids from a formation fluid that would otherwise form as scale, (b) a piezoelectric generator for producing power for the at least one sound transducer, and (c) a connection between the sound transducer and the piezoelectric generator;

wherein the connection between the sound transducer and the piezoelectric generator functions to transfer electromotive force from the piezoelectric generator to the sound transducer.

2. The apparatus of claim 1 wherein the at least one sound transducer is selected from the group consisting of ultrasound transducers, infrasound transducers, and combinations thereof.

3. The apparatus of claim 1 wherein the apparatus is contained in a single housing.

4. The apparatus of claim 1 wherein the apparatus is contained in multiple housings.

5. The apparatus of claim 2 additionally comprising one or more additional sound transducers.

6. The apparatus of claim 1 additionally comprising a pulse flow generator.

7. The apparatus of claim 6 additionally comprising a combination storage device and controller.

8. The apparatus of claim 1 wherein the piezoelectric generators includes more than one piezoelectric array.

9. The apparatus of claim 8 wherein each piezoelectric array of the more than one piezoelectric array is configured to connect to other piezoelectric arrays.

10. The apparatus of claim 9 wherein each piezoelectric array of the more than one piezoelectric array is configured to connect together in parallel.

11. The apparatus of claim 9 wherein each piezoelectric array of the more than one piezoelectric array is configured to connect together in a series.

12. The apparatus of claim 1 wherein the at least one sound transducer operates at a frequency of from about 1 to about 20 khz.

13. The apparatus of claim 1 wherein the piezoelectric generator includes piezoelectric dielectrics prepared from materials selected from the group consisting of quartz, lithium sulphate, barium titanate, lead zirconate titanate, lead magnesium niobate, lead metaniobate ($PbNb_2O_6$), polyviylidenefluoride (PVDF copolymer), and combinations thereof.

14. A method for reducing scaling during oil and gas production comprising placing into a fluid flow path containing formation fluid:

(a) at least one sound transducer for producing sound having a frequency and intensity sufficient to initiate the precipitation of solids from a formation fluid that would otherwise form as scale, (b) a piezoelectric generator for producing power for the at least one sound transducer, and (c) a connection between the sound transducer and the piezoelectric generator;

wherein the connection between the sound transducer and the piezoelectric generator functions to transfer electromotive force from the piezoelectric generator to the sound transducer.

15. The method of claim 14 wherein the at least one sound transducer is selected from the group consisting of ultrasound transducers, infrasound transducers, and combinations thereof.

16. The method of claim 15 wherein the at least one sound transducer is located downhole in an oil well.

17. The method of claim 16 wherein the at least one sound transducer is located downhole in an oil well at the point at which formation fluid reaches saturation.

18. The method of claim 16 wherein the oil well produces from more than one point in a formation and at least one sound transducer is placed at each point producing formation fluid.

19. The method of claim 14 additionally comprising monitoring the function of the at least one sound transducer by using a receiver to detect sound from the at least one sound transducer and sending a message to a remote operator for service when sound from the sound transducer in unexpectedly absent.

20. The method of claim 14 additionally comprising initiating the precipitation of paraffins or asphaltenes.

* * * * *